US010399001B2

(12) United States Patent
Canobbio

(10) Patent No.: US 10,399,001 B2
(45) Date of Patent: Sep. 3, 2019

(54) FLYING POPPER TOY

(71) Applicant: Dan Canobbio, Frisco, TX (US)

(72) Inventor: Dan Canobbio, Frisco, TX (US)

( * ) Notice: Subject to any disclaimer, the term of this patent is extended or adjusted under 35 U.S.C. 154(b) by 0 days.

(21) Appl. No.: 15/934,999

(22) Filed: Mar. 25, 2018

(65) Prior Publication Data

US 2018/0272244 A1 Sep. 27, 2018

Related U.S. Application Data

(60) Provisional application No. 62/476,755, filed on Mar. 25, 2017.

(51) Int. Cl.

| | |
|---|---|
| ***A63H 27/127*** | (2006.01) |
| ***A63H 37/00*** | (2006.01) |
| ***A63H 27/14*** | (2006.01) |
| ***A63H 27/00*** | (2006.01) |
| ***A63H 33/18*** | (2006.01) |
| *A63H 29/22* | (2006.01) |

(52) U.S. Cl.

CPC ..... *A63H 37/005* (2013.01); *A63H 27/12* (2013.01); *A63H 27/14* (2013.01); *A63H 33/18* (2013.01); *A63H 33/185* (2013.01); *A63H 29/22* (2013.01)

(58) Field of Classification Search

CPC ..... A63H 27/12; A63H 27/14

See application file for complete search history.

(56) References Cited

U.S. PATENT DOCUMENTS

| | | | | |
|---|---|---|---|---|
| 2,937,473 A * | 5/1960 | Vlachos | ..... | A63H 27/12 416/20 R |
| 4,204,359 A * | 5/1980 | Plo | ..... | A63H 27/12 446/41 |
| 5,125,862 A * | 6/1992 | Paranto | ..... | A63H 27/14 446/236 |
| 5,362,065 A * | 11/1994 | Su | ..... | A63H 27/12 124/16 |

(Continued)

*Primary Examiner* — John A Ricci

(57) ABSTRACT

Disclosed is a pop-up toy device for recreational purposes of a user. The pop-up toy device includes a flexible elastic hemispherical shell and a propeller unit. The flexible elastic hemispherical shell includes a convex outer surface having an inlet, and a concave inner surface. The propeller unit fits inside the inlet of the convex outer surface. The propeller unit includes a housing unit that fits inside the inlet, a coiled spring is configured in the housing unit and interfaces the coiled spring, a stem attaches to the housing unit and plurality of fan blades attached to the stem. The coiled spring rotates the stem and the plurality of fan blades. The user applies pressure to the convex outer surface to create a near flat surface. The flexible elastic hemispherical shell stores energy when deformed to the near flat surface. The flexible elastic hemispherical shell returns to its original convex outer surface from the near flat surface when dropped onto a fixed surface. The drop results in pop up of the flexible elastic hemi-spherical shell thereby releasing the stored energy. Further during pop up, the fan blades start rotating along with the stem to provide thrust against gravitational pull on the flexible elastic hemi-spherical shell. Furthermore, the stem may be detachably attached to the housing unit and thus detaches from the housing unit during pop-up after drop by the user.

5 Claims, 2 Drawing Sheets

(56) References Cited

U.S. PATENT DOCUMENTS

| | | | | |
|---|---|---|---|---|
| 5,525,086 | A * | 6/1996 | Gentile | A63H 27/10<br>446/234 |
| 7,481,691 | B2 * | 1/2009 | Sze | A63H 27/12<br>124/26 |
| 8,608,598 | B2 * | 12/2013 | Hoang | A63H 33/18<br>446/46 |

* cited by examiner

FLYING POPPER TOY

CROSS REFERENCE TO RELATED APPLICATION

This application claims priority to a U.S. Provisional Application No. 62/476,755 filed on Mar. 25, 2017, the entire content of which is incorporated herein by references in its entirety.

BACKGROUND OF THE INVENTION

1. Field of the Invention

The present invention generally relates to a device for launching projectiles, and more particularly relates to a device for launching projectiles on receiving force from a user.

2. Description of Related Art

Children like to play with the toys which launch objects into the air and also children like to play in groups with toys that can be used to launch objects at each other. Such toys should be designed so that the children are not hurt by the projectile as may happen when launching an object with too much force.

In the toy industry, a pop-up toy is the name commonly given to a class of toys that pop up after having been manually depressed. Such toys commonly have coil springs and suction cups. The spring is manually compressed until the suction cup can engage the surface under the toy. The compressed spring acts to free the suction cup. When the suction cup loses suction, the energy stored by the spring is released and the toy jumps or 'pops' up into the air.

In recent years, toy manufacturers have been becoming more concerned with product safety. Traditional pop-up toys that use compressed springs have certain inherent safety concerns. First, it is difficult to permanently attach a suction cup or a plastic novelty object to a metal spring. If a child pulls upon a traditional pop-up toy, as often happens, the spring detaches, therein exposing a sharp metal point. Furthermore, exposed metal springs have a tendency to pinch skin when compressed. Exposed metal springs also have a tendency to become entangled in a child's hair.

Most of the pop-up toys return back to ground immediately. Also, the pop-up toys rarely use electronics to make it interactive and recreational for the users. Therefore, there is a need of a pop-up toy device with a propeller unit to increase the height of flight during its action and further slowing down the speed of the pop-up toy device as it returns back to ground. Further, the pop-up toy device should include an electronic propeller unit to act against the gravitational pull.

SUMMARY OF THE INVENTION

In accordance with teachings of the present invention, a pop-up toy device for recreational purposes is provided.

An object of the present invention is to provide a pop-up toy device including a flexible elastic hemi-spherical shell and a propeller unit. The flexible elastic hem i-spherical shell is having a convex outer surface and a concave inner surface. The convex outer surface includes an inlet.

The propeller unit fits inside the inlet of the concave inner surface. The propeller unit includes a housing unit, a coiled spring, a stem and plurality of fan blades. The housing unit fits inside the inlet. The coiled spring configured in the housing unit. The stem interfaces the coiled spring which is attached to the housing unit. The plurality of fan blades attached to the stem.

The user applies pressure to the convex outer surface to create a near flat surface. The flexible elastic shell stores energy when deformed to the near flat surface. The flexible elastic shell returns to its original convex outer surface from the near flat surface when dropped onto a fixed surface. The drop results in popping up of the flexible elastic hemispherical shell, thereby releasing the stored energy. Further the fan blades start rotating along with the stem to provide thrust against gravitational pull and lift further into the air.

Another object of the present invention is to provide the pop-up toy device wherein the propeller unit further includes a motor, a sensor, and a battery. The motor is configured in the housing unit to provide torque for rotating the stem and the plurality of fan blades. The sensor is configured in the housing unit to activate the motor. The sensor activates the motor on identifying the contact of the flexible elastic hemispherical shell with the fixed surface.

Another object of the present invention is to provide the pop-up toy device including a knob to hold the flexible elastic hemi-spherical shell. The knob allows the user to hold the flexible elastic hemispherical shell firmly. Further, the knob allows the user to drop the flexible elastic hem i-spherical shell.

Another object of the present invention is to provide the stem that detachably attaches to the housing unit. Thus, when the user drops the flexible elastic hemispherical shell from the near flat surface onto a fixed surface, then during pop-up the stem detaches from the housing unit and the fan blades start rotating along with the stem providing thrust against the gravitational pull.

These and other features and advantages will become apparent from the following detailed description of illustrative embodiments thereof, which is to be read in connection with the accompanying drawings.

BRIEF DESCRIPTION OF THE DRAWINGS

The disclosure will provide details in the following description of preferred embodiments with reference to the following figures wherein.

Figure 1:
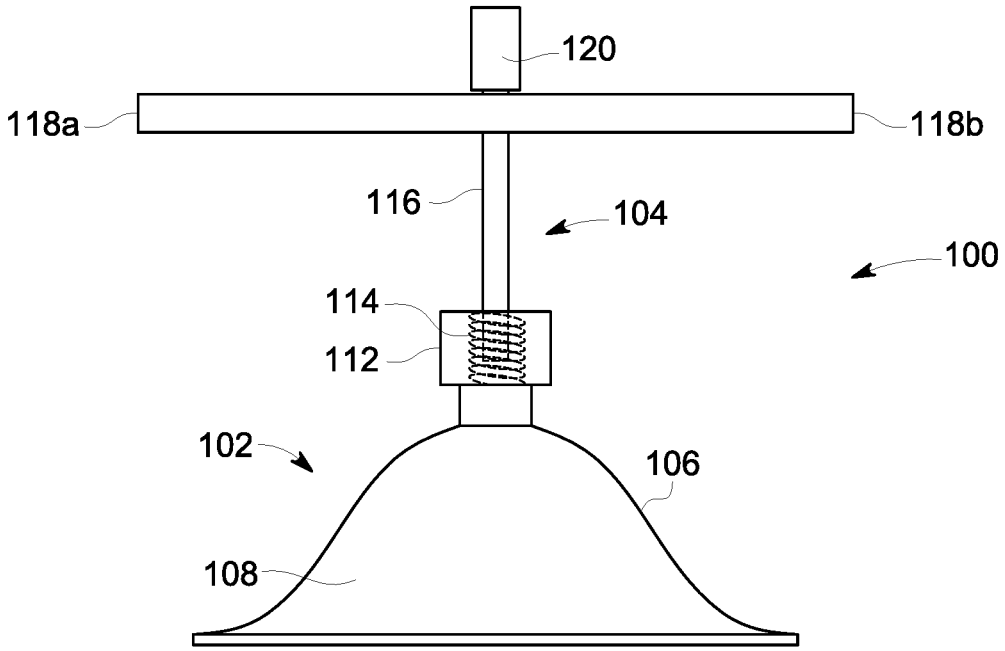
FIG. 1 illustrates a perspective view of a pop-up toy device in accordance with a preferred embodiment of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE DRAWINGS

While the specification concludes with claims defining the features of the invention, a pop-up toy device for recreational purposes of a user will be better understood from a consideration of the following description in conjunction with the figures, in which every major element has been given a reference number. As required, the detailed embodiments of the present invention have been included herein. However, it must be understood that the disclosed embodiments are merely exemplary of the invention, which may be embodied in various forms. Therefore, the structural and functional details that have been disclosed should not be interpreted as limiting. They must merely be taken as the basis for the claims and as a representative basis for teaching one skilled in the specific domain to variously employ the present invention in virtually any appropriately detailed structure. Further, the terms, phrases and examples used herein are not intended to be limiting, but are rather intended to provide an understandable description of the invention.

FIG. 1 illustrates a perspective view of a pop-up toy device 100 in accordance with a preferred embodiment of the present invention. The pop-up toy device 100 includes a flexible elastic hemispherical shell 102 and a propeller unit 104. The flexible elastic hemispherical shell 102 includes a convex outer surface 106 and a concave inner surface 108. The convex outer surface 106 includes an inlet (110, show in FIG. 2).

The propeller unit 104 fits inside the inlet 110 (shown in FIG. 2) of the convex outer surface 106. The propeller unit 104 includes a housing unit 112, a coiled spring 114, a stem 116 and plurality of fan blades 118*a*, 118*b*. The housing unit 112 fits inside the inlet 110 (shown in FIG. 2). The coiled spring 114 is configured within the housing unit 112.

The stem 116 interfaces the coiled spring 114 and is further configured in the housing unit 112. The coiled spring 114 rotates the stem 116. The plurality of fan blades 118*a*, 118*b* is attached to the stem 116. The user applies pressure to the convex outer surface 106 to create a near flat surface. The flexible elastic hemispherical shell stores energy when deformed to the near flat surface.

The flexible elastic hemispherical shell 102 returns to its original convex outer surface 106 from the near flat surface when dropped onto a fixed surface. The drop results in pop up of the flexible elastic hemispherical shell 106 thereby releasing the stored energy. Further, the fan blades 118*a*, 118*b* starts rotating in air along with the stem 116 to provide thrust against gravitational pull.

In a preferred embodiment of the present invention, the fixed surface is a floor. It would be readily apparent to those skilled in the art that the pop-up toy device may be drop or thrown on to a fixed surface such as wall or roof or any other fixed surfaces without deviating from the scope of the present invention.

The flexible elastic hemispherical shell 102 is molded from flexible rubber that may be bent out of shape but will generally stay in the manipulated position until an external force is applied thereto. The flexible elastic hemispherical shell 102 is, in its regular position, half-dome or hemispherical in shape, with an empty inner portion. It is single curved piece of rubber, similar in shape to a squash ball or tennis ball cut in half.

The inlet 110 (shown in FIG. 2) is an opening to allow receiving of the housing unit 112. The inlet 110 (shown in FIG. 2) opening may be either circular, spherical, and may be other geometrical shape. The housing unit 112 is attached to the flexible elastic hemispherical shell 102 through the inlet 110 (shown in FIG. 2). The housing unit 112 is generally cylindrical shape, however, it would be readily apparent to those skilled in the art that various shapes of the housing unit 112 may be envisioned without deviating from the scope of the present invention.

The coiled spring 114 is also known as a helical spring. The coiled spring 114 is a mechanical device which is typically used to store energy and subsequently release it, to absorb shock, or to maintain a force between contacting surfaces. The stem 116 is cylindrical and interfaces within the coiled spring 114.

The fan blades 118*a*, 118*b* are rectangular in shape and are attached to the stem 116. The fan blades 118*a* and 118*b* rotates along with the rotation of stem 116 as soon as the flexible elastic hemispherical shell 102 reaches into after pop up from the ground. It would be apparent to those skilled in the art that various numbers and shapes of blades may be used without deviating from the scope of the present invention.

In another preferred embodiment of the present invention, the stem 116 detachably attaches to the housing unit 112. Thus, during pop-up the stem 116 detaches from the housing unit 112. The fan blades 118*a*, 118*b* starts rotating along with the stem 116 providing thrust against the gravitational pull.

It would be readily apparent to those skilled in the art that various mechanical units may be used to detachably attach the stem 116 to the housing unit 112 without deviating from the scope of the present invention. The mechanical unit may be lock pin faster that detachably attaches the stem 116 to the housing unit 112 and opens on being dropped on the ground by the user.

In another preferred embodiment of the present invention, a knob 120 attached to the center of the joint of plurality of fan blades 118*a*, 118*b* and further the knob 120 is aligned parallel to the stem 116. The knob 120 allows the user to hold the flexible elastic hemispherical shell 102. Further, the knob 120 allows the user to spin and gain more force for the flexible elastic hemispherical shell 102 and the propeller unit 104 to pop-up.

Figure 2:
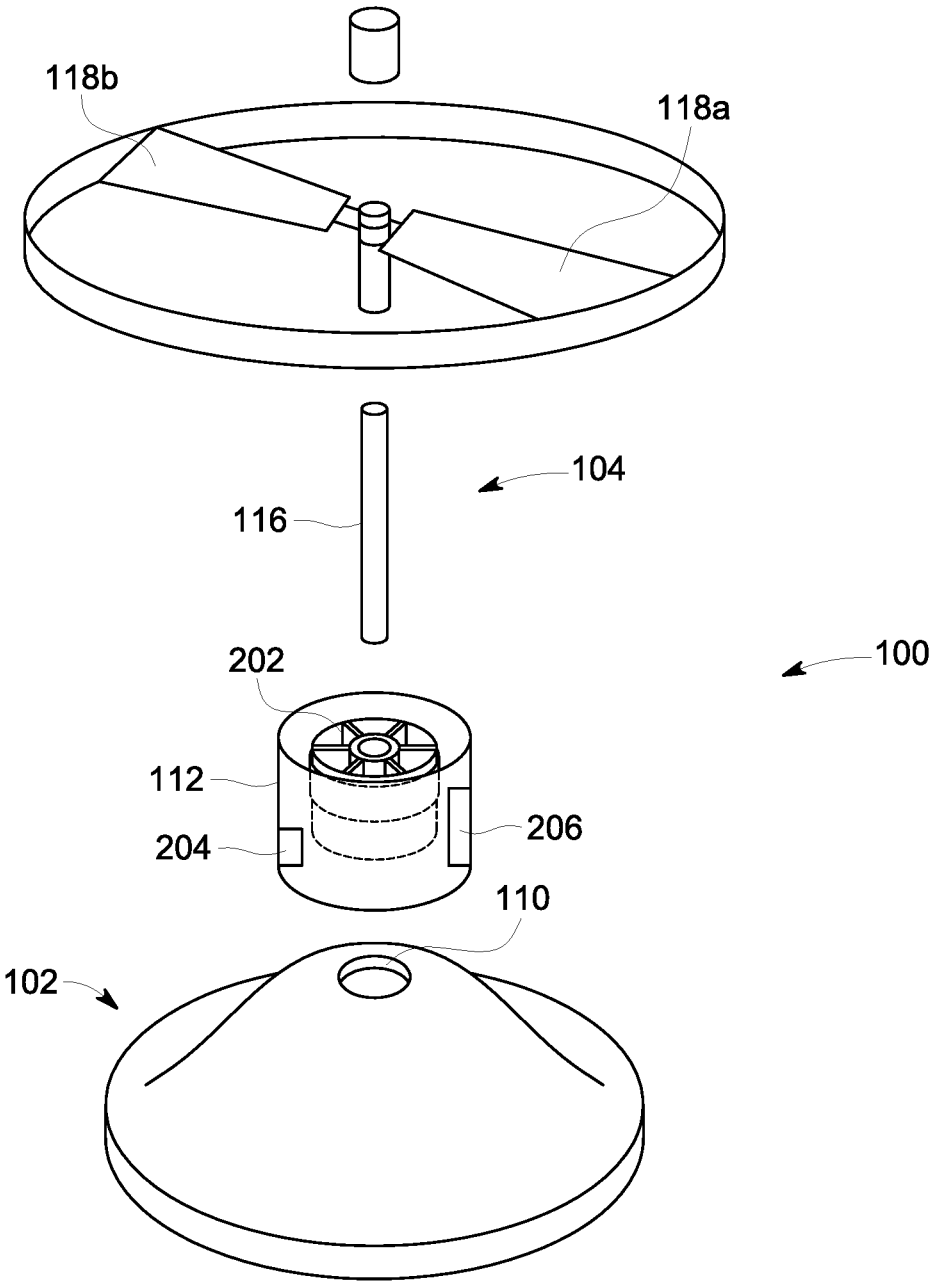
FIG. 2 illustrates an exploded view of the pop-up toy device in accordance with another preferred embodiment of the present invention.

FIG. 2 illustrates an exploded view of the pop-up toy device 100 in accordance with another preferred embodiment of the present invention. The propeller unit 104 further includes a motor 202, a sensor 204 and a battery 206. The motor 202 is configured in the housing unit 112 to provide torque for rotating the stem 116 and the plurality of fan blades 118*a*, 118*b*.

The sensor 204 is configured in the housing unit 112 to activate the motor 202. The sensor 204 activates the motor on identifying the contact of the flexible elastic hemispherical shell 102 with the fixed surface. The sensor 204 may either be a pressure sensor or a touch sensor. The battery 206 is further configured within the housing unit 112 to power the sensor 204 and the motor 202.

As shown in FIG. 2, the flexible elastic hemispherical shell 102 is deformed into the near flat surface. The near flat surface is flat from the edges and curved from the center. The near flat surface allows maximum pop-up when dropped by the user. The near flat surface stores maximum energy which is released when dropped by the user.

The present invention offers various advantages such as allowing the users to play with the pop-up toy devices which have more interactive features. The pop-up toy device includes a propeller that increases the flight time of the pop-up toy device and thus increases the interest to the user. The electronic propeller unit brings more interest to the user as it further increases the flight time and thus allow the kids to enjoy more time outdoors.

The many features and advantages of the invention are apparent from the above description. It is apparent from the foregoing that a new and improved amusement ball has been provided. The invention is quite simple and can be used on different surfaces. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A pop-up toy device for recreational purposes of a user, the pop-up toy device comprising:

a flexible elastic hemispherical shell having a convex outer surface; and a concave inner surface, the convex outer surface having an inlet; and a propeller unit to fit inside the inlet of the convex outer surface, the propeller unit comprising:

a housing unit to fit inside the inlet;

a motor configured in the housing unit to provide torque;

a stem configured to attach with the motor and further receives torque from the motor; and a plurality of fan blades attached to the stem rotates on receiving torque from the motor;

a sensor configured in the housing unit to activate the motor; and a battery to power the motor and the sensor;

wherein the user applies pressure to the convex outer surface to create a near flat surface, the flexible elastic hemispherical shell stores energy when deformed to the near flat surface, the flexible elastic hemispherical shell returns to its original convex outer surface from the near flat surface when dropped onto a fixed surface, the drop results in popping up of the flexible elastic hemispherical shell thereby releasing the stored energy, and the sensor activates the motor on identifying the contact of the near flat surface with the fixed surface, which causes the fan blades to start rotating along with the stem to provide thrust against gravitational pull on the flexible elastic hemispherical shell.

2. The pop-up toy device according to claim 1 wherein the sensor further activates the motor for a pre-determined duration to rotate the fan blades and the stem.

3. The pop-up toy device according to claim 1 further comprising a knob to hold the flexible elastic hemispherical shell.

4. A pop-up toy device for recreational purposes of a user, the pop-up toy device comprising:

a flexible elastic hemispherical shell having a convex outer surface; and a concave inner surface, the convex outer surface having an inlet; and a propeller unit to fit inside the inlet of the convex outer surface, the propeller unit comprising:

a housing unit to fit inside the inlet;

a coiled spring configured within the housing unit;

a stem interfaces the coiled spring and further the stem detachably attaches to the housing unit, wherein the coiled spring rotates the stem; and plurality of fan blades attached to the stem;

wherein the user applies pressure to the convex outer surface to create a near flat surface, the flexible elastic hemispherical shell stores energy when deformed to the near flat surface, the flexible elastic hemispherical shell returns to its original convex outer surface from the near flat surface when dropped onto a fixed surface, the drop results in pop up of the flexible elastic hemispherical shell thereby releasing the stored energy, and further during pop up the stem detaches from the housing unit and the fan blades start rotating along with the stem providing thrust against the gravitational pull.

5. The pop-up toy device according to claim 4 further comprising a knob to hold the flexible elastic hemispherical shell.

* * * * *